US012650229B1

(12) United States Patent
Berry et al.

(10) Patent No.: US 12,650,229 B1
(45) Date of Patent: Jun. 9, 2026

(54) HYDROGEN CAPABLE FUEL INJECTOR AND ASSEMBLY

(71) Applicant: GE Verona Infrastructure Technology LLC, Greenville, SC (US)

(72) Inventors: Jonathan Dwight Berry, Simpsonville, SC (US); George Andrew Gergely, Simpsonville, SC (US); Justin Mark Bailey, Greenville, SC (US)

(73) Assignee: GE Vernova Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 18/971,630

(22) Filed: Dec. 6, 2024

(51) Int. Cl.
*F23R 3/28* (2006.01)
*F23R 3/34* (2006.01)

(52) U.S. Cl.
CPC ..... *F23R 3/286* (2013.01); *F23R 3/346* (2013.01); *F23R 2900/00002* (2013.01)

(58) Field of Classification Search
CPC ..... F23R 3/286; F23R 3/346
See application file for complete search history.

(56) References Cited

U.S. PATENT DOCUMENTS 8,752,386 B2 * 6/2014 Fox ..... F23R 3/286 60/737
9,366,443 B2 6/2016 Laster et al.
10,184,666 B2 1/2019 Meadows et al.
10,465,909 B2 11/2019 Boardman et al.
11,566,790 B1 1/2023 Hughes et al.
2004/0035114 A1 * 2/2004 Hayashi ..... F23R 3/18 60/737
2009/0277182 A1 11/2009 Englebrecht et al.
2010/0170253 A1 * 7/2010 Berry ..... F23R 3/286 60/742
2010/0229557 A1 9/2010 Matsumoto et al.
2014/0208757 A1 7/2014 Fox et al.
2015/0159875 A1 * 6/2015 Berry ..... F23R 3/343 60/737
2017/0051919 A1 * 2/2017 Dolmansley ..... F23R 3/286
2017/0227225 A1 8/2017 DiCintio et al.
2018/0209651 A1 7/2018 Cai et al.
2018/0266694 A1 * 9/2018 Johnson ..... F23R 3/286
2019/0301738 A1 * 10/2019 North ..... F23R 3/286
2021/0199299 A1 * 7/2021 Berry ..... B01F 25/311
(Continued)

OTHER PUBLICATIONS

European Search Report Corresponding to Application No. 25202494 on Mar. 5, 2026.

*Primary Examiner* — Andrew H Nguyen
(74) *Attorney, Agent, or Firm* — Dority & Manning, P.A.

(57) ABSTRACT

A hydrogen capable fuel injector for a combustor of a gas turbine is provided. The fuel injector includes an annular body extending from a first end to a second end and a fuel circuit at least partially disposed in the annular body. The annular body defines a centerline axis extending from the first end to the second end. The fuel circuit includes a fuel plenum, a primary fuel outlet in fluid communication with the fuel plenum and extending along the centerline axis, and a plurality of secondary fuel outlets in fluid communication with the fuel plenum and disposed radially about the primary fuel outlet. The fuel injector also includes a first plurality of fluid channels radially disposed about the centerline axis and a second plurality of fluid channels radially disposed about the first plurality of fluid channels.

18 Claims, 9 Drawing Sheets

(56) References Cited

U.S. PATENT DOCUMENTS

| | | | | |
|---|---|---|---|---|
| 2023/0065831 | A1* | 3/2023 | Oskam | F23D 14/58 |
| 2023/0266009 | A1* | 8/2023 | Naik | F23R 3/286<br>60/737 |
| 2023/0296253 | A1* | 9/2023 | Miranda | F02C 9/40<br>60/773 |
| 2024/0110520 | A1* | 4/2024 | Dudebout | F23R 3/36 |

* cited by examiner

HYDROGEN CAPABLE FUEL INJECTOR AND ASSEMBLY

FEDERALLY SPONSORED RESEARCH

This invention was made with government support under contract number DE-FE0032173 awarded by the Department of Energy. The U.S. government may have certain rights in the invention.

FIELD

The present disclosure relates generally to fuel injectors for gas turbine combustors.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine engine via the exhaust section.

In some combustors, the generation of combustion gases occurs at two or more axially spaced stages. Such combustors are referred to herein as including an "axial fuel staging" (AFS) system, which delivers fuel and an oxidant to one or more fuel injectors downstream of the head end of the combustor. In a combustor with an AFS system, a primary fuel nozzle at an upstream end of the combustor injects fuel and air (or a fuel/air mixture) in an axial direction into a primary combustion zone, and an AFS fuel injector located at a position downstream of the primary fuel nozzle injects fuel and air (or a second fuel/air mixture) as a cross-flow into a secondary combustion zone downstream of the primary combustion zone. The cross-flow is generally transverse to the flow of combustion products from the primary combustion zone.

Traditional gas turbine engines include one or more combustors that burn a mixture of natural gas and air within the combustion chamber to generate the high pressure and temperature combustion gases. As a byproduct, oxides of nitrogen (NOx), carbon dioxide ($CO_2$), and other pollutants are created and expelled by the exhaust section. Regulatory requirements for low emissions from gas turbines are continually growing more stringent, and environmental agencies throughout the world are now requiring even lower rates of emissions of NOx and other pollutants from both new and existing gas turbines.

Burning a blend of natural gas and high amounts of hydrogen and/or burning pure hydrogen instead of natural gas within the combustor would significantly reduce or eliminate the emission of $CO_2$. However, because hydrogen burning characteristics are different than those of natural gas, traditional combustion systems, including traditional AFS fuel injectors, are not capable of burning high levels of hydrogen and/or pure hydrogen without issue. For example, burning high levels of hydrogen and/or pure hydrogen within a traditional combustion system could promote flashback or flame holding conditions in which the combustion flame migrates towards the fuel being supplied by the injector, possibly causing severe damage to the injector in a relatively short amount of time.

As such, a fuel injector capable of delivering alternative fuels (such as hydrogen) and air to a secondary combustion zone, without causing flame holding or flashback issues, is desired in the art.

BRIEF DESCRIPTION

Aspects and advantages of the fuel injector and fuel injection assembly in accordance with the present disclosure will be set forth in part in the following description, or may be obvious from the description, or may be learned through practice of the technology.

In accordance with one embodiment, a fuel injector for a combustor of a gas turbine is provided. The fuel injector includes an annular body extending from a first end to a second end and a fuel circuit at least partially disposed in the annular body. The annular body defines a centerline axis extending from the first end to the second end. The fuel circuit includes a fuel plenum, a primary fuel outlet in fluid communication with the fuel plenum and extending along the centerline axis, and a plurality of secondary fuel outlets in fluid communication with the fuel plenum and disposed radially about the primary fuel outlet. The fuel injector also includes a first plurality of fluid channels radially disposed about the centerline axis and a second plurality of fluid channels radially disposed about the first plurality of fluid channels. The first plurality of fluid channels is in fluid communication with the plurality of secondary fuel outlets.

In accordance with another embodiment, a combustor is provided. The combustor includes at least one fuel source, a combustion liner extending in a downstream direction and defining a combustion chamber, an outer sleeve spaced apart from and surrounding the combustion liner such that an annulus is defined therebetween, and a fuel injection assembly in fluid communication with the at least one fuel source. The fuel injection assembly includes a housing extending between a first end and a second end. The first end of the housing defines a fuel chamber in fluid communication with the at least one fuel source, and the second end of the housing defines at least one mixing chamber. At least one fuel injector is disposed in the housing and in fluid communication with the fuel chamber and the at least one mixing chamber. The at least one fuel injector includes an annular body extending from a first end to a second end and a fuel circuit at least partially disposed in the annular body. The annular body defines a centerline axis extending from the first end to the second end. The fuel circuit includes a fuel inlet nozzle in fluid communication with the fuel chamber, a fuel plenum in fluid communication with the fuel inlet nozzle, a primary fuel outlet in fluid communication with the fuel plenum and extending along the centerline axis, a plurality of secondary fuel outlets in fluid communication with the fuel plenum and disposed radially about the primary fuel outlet, a first plurality of fluid channels radially disposed about the centerline axis, and a second plurality of fluid channels radially disposed about the first plurality of fluid channels. The first plurality of fluid channels is in fluid communication with the plurality of secondary fuel outlets.

These and other features, aspects and advantages of the present fuel injector and fuel injection assembly will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present fuel injector and fuel injection assembly, including the best mode of making and using the present systems and methods, directed to one of ordinary skill in the art, is set forth in the specification, which makes reference to the appended figures, in which.

DETAILED DESCRIPTION

Figure 1:
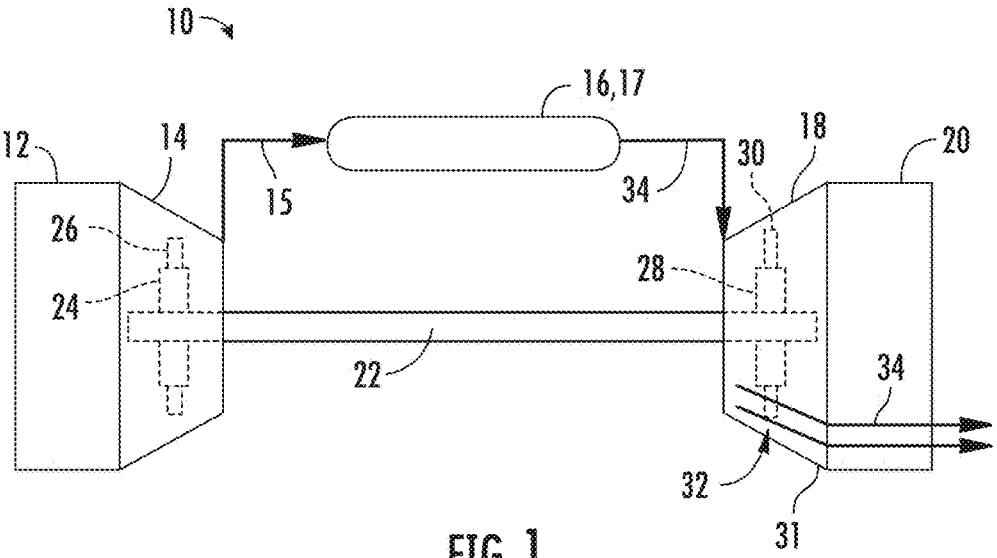
FIG. 1 is a schematic illustration of a turbomachine, in accordance with embodiments of the present disclosure.

Reference now will be made in detail to embodiments of the present fuel injector and fuel injection assembly, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the subject technology. As used herein, the terms "first," "second," and "third" may be used interchangeably to distinguish one component from another and are not intended to signify location or importance of the individual components.

The term "fluid" may refer to a gas or a liquid. The term "fluid communication" means that a fluid is capable of flowing or being conveyed between the areas specified.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component; the term "axially" refers to the relative direction that is substantially parallel and/or coaxially aligned to an axial centerline of a particular component; and the term "circumferentially" refers to the relative direction that extends around the axial centerline of a particular component.

Terms of approximation, such as "about," "approximately," "generally," and "substantially," are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value or the precision of the methods or machines for constructing or manufacturing the components and/or systems. For example, the approximating language may refer to being within a 1, 2, 4, 5, 10, 15, or 20 percent margin in either individual values, range(s) of values, and/or endpoints defining range(s) of values. When used in the context of an angle or direction, such terms include within five degrees greater or less than the stated angle or direction. For example, "generally vertical" includes directions within five degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. The terms "directly coupled," "directly fixed," "directly attached to," and the like indicate that a first component is joined to a second component with no intervening structures. As used herein, the terms "comprises." "comprising," "includes." "including," "has," "having" or any other variations thereof, are intended to cover a non-exclusive inclusion. For example, a process, method, article, or apparatus that comprises a list of features is not necessarily limited only to those features but may include other features not expressly listed or inherent to such process, method, article, or apparatus.

Here and throughout the specification and claims, range limitations are identified and include all the sub-ranges contained therein unless context or language indicates otherwise. For example, all ranges disclosed herein are inclusive of the endpoints, and the endpoints are independently combinable with each other.

As used herein, the term "premix" may be used to describe a component, passage, or cavity upstream of a respective combustion zone within which mixing of two (or more) fluids occurs. For example, "premix" may be used to describe a component, passage, or cavity in which two fluids (such as fuel and air) are mixed together prior to being ejected from such component, passage, or cavity (e.g., into a combustion zone).

Referring now to the drawings, FIG. 1 illustrates a schematic diagram of an exemplary embodiment of a turbomachine, which in the illustrated embodiment is a gas turbine engine 10. Although an industrial or land-based gas turbine is shown and described herein, the present disclosure is not limited to an industrial or land-based gas turbine engine unless otherwise specified in the claims. For example, the technology as described herein may be used in any type of turbomachine including but not limited to a steam turbine, an aircraft gas turbine, or a marine gas turbine.

As shown, the gas turbine engine 10 generally includes an inlet section 12, a compressor section 14 disposed downstream of the inlet section 12, a plurality of combustors 17 (shown in FIG. 2) within a combustion section 16 disposed downstream of the compressor section 14, a turbine section 18 disposed downstream of the combustion section 16, and an exhaust section 20 disposed downstream of the turbine section 18. Additionally, the gas turbine engine 10 may include one or more shafts 22 coupled between the compressor section 14 and the turbine section 18. The shaft 22 may be coupled to a generator, not shown, for producing electricity.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form an upstream portion of the shaft 22 that extends through the compressor section 14. The compressor section 14 further includes a plurality of stationary vanes (not shown), which are arranged in stages with the rotor blades 26 and which direct the flow against the rotor blades 26.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a downstream portion of the shaft 22 that extends through the turbine section 18. The turbine section 18 further includes an outer casing 31 that circumferentially surrounds the downstream portion of the shaft 22 and the rotor blades 30, thereby at least partially defining a hot gas path 32 through the turbine section 18. The turbine section 18 further includes a plurality of stationary vanes (not shown), which are arranged in stages with the rotor blades 30 and which direct the flow against the rotor blades 30.

During operation, a working fluid such as air flows through the inlet section 12 and into the compressor section 14 where the air is progressively compressed by multiple compressor stages of rotating blades 26 and stationary vanes, thus providing compressed air 15 to the combustors 17 of the combustion section 16. The compressed air 15 is mixed with fuel and burned within each combustor 17 to produce combustion gases 34. The combustion gases 34 flow through the hot gas path 32 from the combustion section 16 into the turbine section 18, in which energy (kinetic and/or thermal) is transferred from the combustion gases 34 to the rotor blades 30, causing the shaft 22 to rotate. The mechanical rotational energy may then be used to power the compressor section 14 and/or to generate electricity. The combustion gases 34 exiting the turbine section 18 may then be exhausted from the gas turbine engine 10 via the exhaust section 20.

Figure 2:
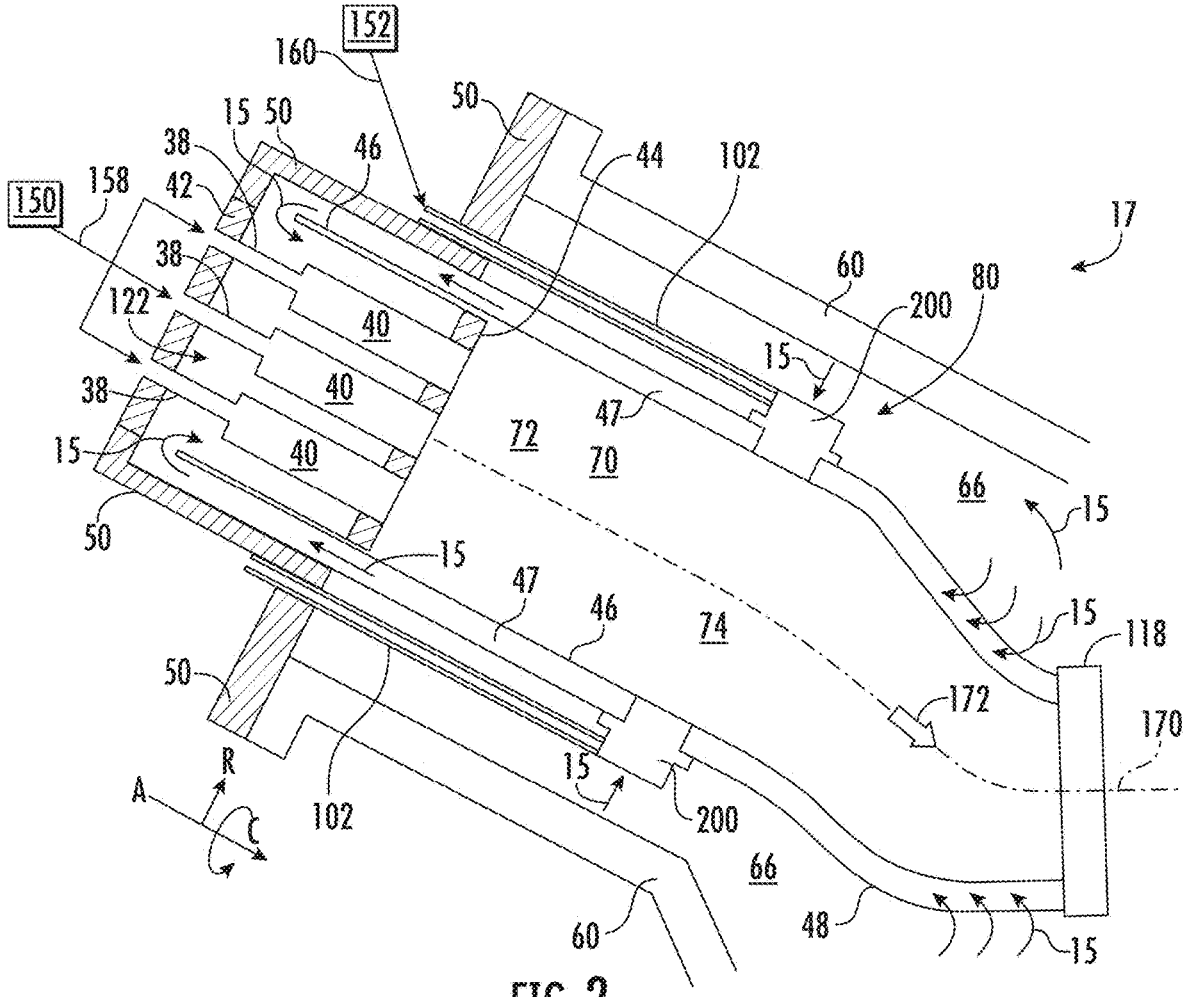
FIG. 2 is a schematic view of a combustor as may be employed in the turbomachine of FIG. 1, in accordance with embodiments of the present disclosure.

FIG. 2 is a schematic representation of the combustor 17 as may be included in the combustion section 16 of the gas turbine engine 10. The combustion section 16 may be a can annular combustion system. In a can annular combustion system, a plurality of combustors 17 (e.g., 8, 10, 12, 14, 16, or more) are positioned in an annular array about the shaft 22.

As shown in FIG. 2, the combustor 17 may define a cylindrical coordinate system. The cylindrical coordinate system may define an axial direction A (e.g. a downstream direction) substantially parallel to and/or along an axial centerline 170 of the combustor 17, a radial direction R perpendicular to the axial centerline 170, and a circumferential direction C extending around the axial centerline 170.

The combustor 17 includes a combustion liner 46 that defines a combustion chamber 70 within which combustion occurs. The combustion liner 46 may be positioned within (i.e., circumferentially surrounded by) an outer sleeve 48, such that an annulus 47 is formed therebetween. The combustion liner 46 may contain and convey combustion gases to the turbine section 18. As shown in FIG. 2, the combustion liner 46 may extend between at least one fuel nozzle 40 and an aft frame 118. The combustion liner 46 may have a generally cylindrical liner portion and a tapered transition portion that is separate from the generally cylindrical liner portion, as in many conventional combustion systems. Alternately, the combustion liner 46 may have a unified body (or "unibody") construction, in which the generally cylindrical portion and the tapered portion are integrated with one another. Thus, any discussion of the combustion liner 46 herein is intended to encompass both conventional combustion systems having a separate liner and transition piece and those combustion systems having a unibody liner. Moreover, the present disclosure is equally applicable to those combustion systems in which the transition piece and the stage one nozzle of the turbine section 18 are integrated into a single unit (without aft frame 118), sometimes referred to as a "transition nozzle" or an "integrated exit piece."

FIG. 2 illustrates a combustor 17 having both the at least one fuel nozzle 40 and a fuel injection assembly 80 (also referred to as an axial fuel staging ("AFS") system), as discussed further herein. The at least one fuel nozzle 40 may be positioned at the forward end of the combustor 17. Fuel may be directed through fuel supply conduits 38, which extend through an end cover 42, and into the at least one fuel nozzle 40. The at least one fuel nozzle 40 convey the fuel and compressed air 15 into a primary combustion zone 72, where combustion occurs. In some embodiments, the fuel and compressed air 15 are combined as a mixture prior to reaching the primary combustion zone 72 (i.e., are "pre-mixed").

The combustion liner 46 may be surrounded by an outer sleeve 48, which is spaced radially outward of the combustion liner 46 to define an annulus 47 through which compressed air 15 flows to a head end of the combustor 17. For example, compressed air 15 may enter the annulus 47 through the outer sleeve 48 (e.g., through impingement holes proximate the aft frame 118) and travel towards the end cover 42, such that the compressed air 15 within the annulus 47 flows opposite the direction of combustion gases 172 (34 in FIG. 1) within the combustion liner 46. Heat is transferred convectively from the combustion liner 46 to the compressed air 15, thus cooling the combustion liner 46 and warming the compressed air 15.

In some exemplary embodiments, the outer sleeve 48 may include a flow sleeve and an impingement sleeve coupled to one another. The flow sleeve may be disposed at the forward end, and the impingement sleeve may be disposed at the aft end. Alternately, the outer sleeve 48 may have a unified body (or "unisleeve") construction, in which the flow sleeve and the impingement sleeve are integrated with one another in the axial direction. As before, any discussion of the outer sleeve 48 herein is intended to encompass both conventional combustion systems having a separate flow sleeve and impingement sleeve and combustion systems having a unisleeve outer sleeve.

The forward casing 50 and the end cover 42 of the combustor 17 define the head end air plenum 122, which includes the at least one fuel nozzle 40. The at least one fuel nozzle 40 may be any type of fuel nozzle, such as bundled tube fuel nozzles or swirler nozzles (often referred to as "swozzles"). The at least one fuel nozzle 40 may be positioned within the head end air plenum 122 defined at least partially by the forward casing 50. In many embodiments, the at least one fuel nozzle 40 may extend from the end cover 42. For example, each of the at least one fuel nozzle 40 may be coupled to an aft surface of the end cover 42 via a flange (not shown). As shown in FIG. 2, the at least one fuel nozzle 40 may be partially surrounded by the combustion liner 46. The aft, or downstream ends, of the at least one fuel nozzle 40 extend through or collectively define a cap plate 44 that defines the upstream end of the combustion chamber 70.

The at least one fuel nozzle 40 may be in fluid communication with a first fuel source, such as a first fuel supply 150, configured to supply a first fuel 158 to the at least one fuel nozzle 40. In many embodiments, the first fuel 158 may be a fuel mixture containing natural gas (such as one or more of methane, ethane, propane, or other suitable natural gas) and hydrogen. In some embodiments, the hydrogen may be a majority component (e.g., more than 50%) of the fuel mixture. In other embodiments, the first fuel 158 may be pure natural gas or pure hydrogen (e.g., 100% hydrogen, which may or may not contain some trace amount of contaminants), such that the first fuel is not a mixture of multiple fuels. In exemplary embodiments, the first fuel 158 and compressed air 15 may mix together within the at least one fuel nozzle 40 to form a first mixture of compressed air 15 and the first fuel 158 before being ejected (or injected) by the at least one fuel nozzle 40 into the primary combustion zone 72.

The forward casing 50 may be fluidly and mechanically connected to a compressor discharge casing 60, which defines a high-pressure plenum 66 around the combustion liner 46 and the outer sleeve 48. Compressed air 15 from the compressor section 14 travels through the high-pressure plenum 66 and enters the combustor 17 via apertures (not shown) in the downstream end of the outer sleeve 48 (as indicated by arrows near the aft frame 118). Compressed air travels upstream through the annulus 47 and is turned by the end cover 42 to enter the at least one fuel nozzle 40 and to cool the head end. In particular, compressed air 15 flows from high-pressure plenum 66 into the annulus 47 at an aft end of the combustor 17, via openings defined in the outer sleeve 48. The compressed air 15 travels upstream from the aft end of the combustor 17 to the head end air plenum 122, where the compressed air 15 reverses direction and enters the at least one fuel nozzle 40.

In the exemplary embodiment shown in FIG. 2, the fuel injection assembly 80 is provided to deliver a second fuel/air mixture to a secondary combustion zone 74 downstream from the primary combustion zone 72. For example, a second flow of fuel and air may be introduced by at least one fuel injector 200 to the secondary combustion zone 74.

The primary combustion zone 72 and the secondary combustion zone 74 may each be portions of the combustion chamber 70 and therefore may be defined by the combustion liner 46. For example, the primary combustion zone 72 may be defined from an outlet of the at least one fuel nozzle 40 to the at least one fuel injector 200, and the secondary combustion zone 74 may be defined from the at least one fuel injector 200 to the aft frame 118. In this arrangement, the forwardmost boundary of the at least one fuel injector 200 may define the end of the primary combustion zone 72 and the beginning of the secondary combustion zone 74 (e.g., at an axial location where a second flow of fuel and air are introduced).

Such a combustion system having axially separated combustion zones is described herein as an axial fuel staging ("AFS") system. The fuel injection assemblies 80 may be circumferentially spaced apart from one another on the outer sleeve 48 (e.g., equally spaced apart in some embodiments). In some example embodiments, the combustor 17 may include four fuel injection assemblies 80 circumferentially spaced apart from one another and configured to inject a second mixture of fuel and air into a secondary combustion zone 74 via the at least one fuel injector 200. In other example embodiments, the combustor 17 may include any number of fuel injection assemblies 80 (e.g., 1, 2, 3, or up to 10).

As shown in FIG. 2, each fuel injection assembly 80 may include at least one fuel injector 200. The fuel injector 200 may be coupled to the outer sleeve 48. For example, the fuel injector 200 may couple to a radially outer surface of the outer sleeve 48 and extend radially through the annulus 47 between the outer sleeve 48 and the combustion liner 46.

A fuel supply conduit 102 may fluidly couple to each fuel injector 200. Each fuel injector 200 may be in fluid communication with a fuel source, such as a second fuel supply 152, configured to supply a second fuel 160 to the respective fuel injector 200 via the fuel supply conduit 102. The second fuel supply 152 may be the same as or different from the first fuel supply 150, such that the fuel injector 200 may be supplied with the same fuel or a different fuel than the fuel nozzle 40. In many embodiments, the second fuel 160 may be a fuel mixture containing natural gas (such as one or more of methane, ethane, propane, or other suitable natural gas) and hydrogen. In some embodiments, the hydrogen may be a majority component (e.g., more than 50%) of the fuel mixture. In other embodiments, the second fuel 160 may be pure natural gas or pure hydrogen (e.g., 100% hydrogen, which may or may not contain some trace amount of contaminants), such that the first fuel is not a mixture of multiple fuels. In exemplary embodiments, the second fuel 160 and compressed air 15 may mix together within the fuel injector 200 to form a mixture of compressed air 15 and the second fuel 160 before being injected into the secondary combustion zone 74.

Figure 3A:
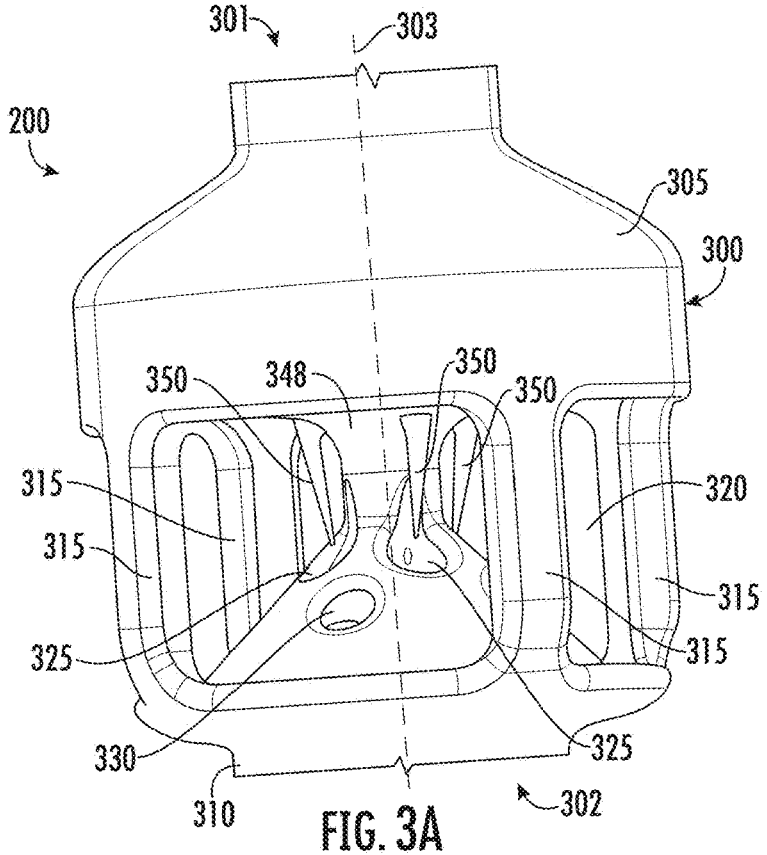
FIG. 3A is a perspective view of a fuel injector as may be employed in the combustor of FIG. 2, in accordance with embodiments of the present disclosure.
Figure 3B:
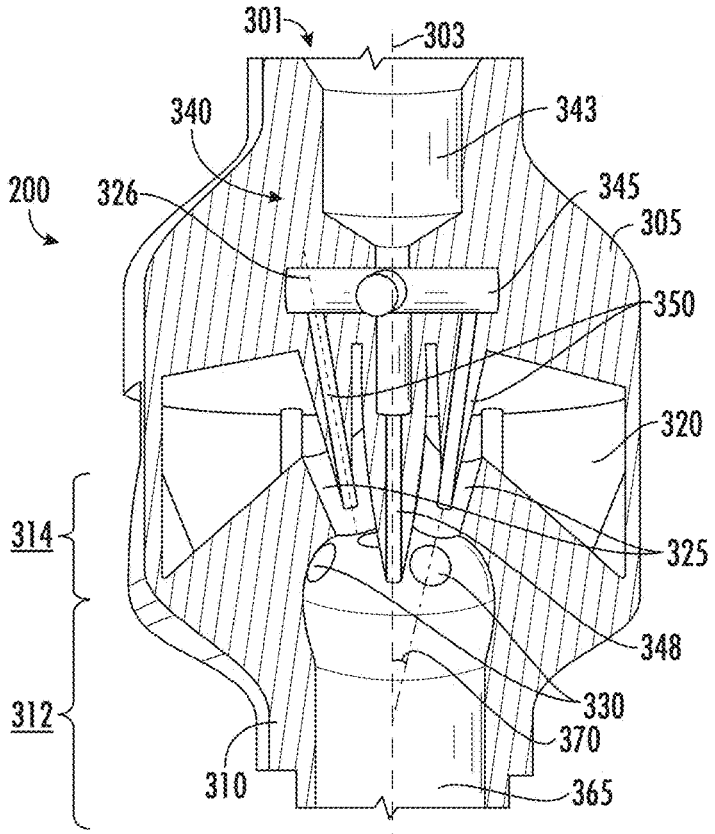
FIG. 3B is an interior, cross-sectional view of the fuel injector of FIG. 3A, in accordance with embodiments of the present disclosure.
Figure 3C:
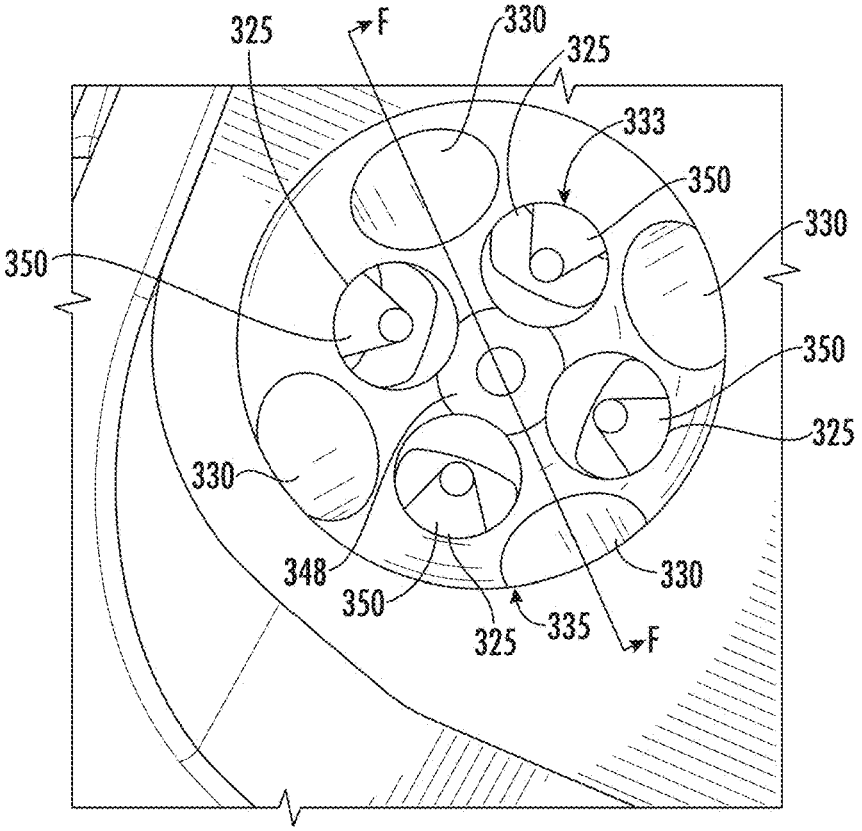
FIG. 3C is a bottom view of the fuel injector of FIG. 3A, in accordance with embodiments of the present disclosure.
Figure 3D:
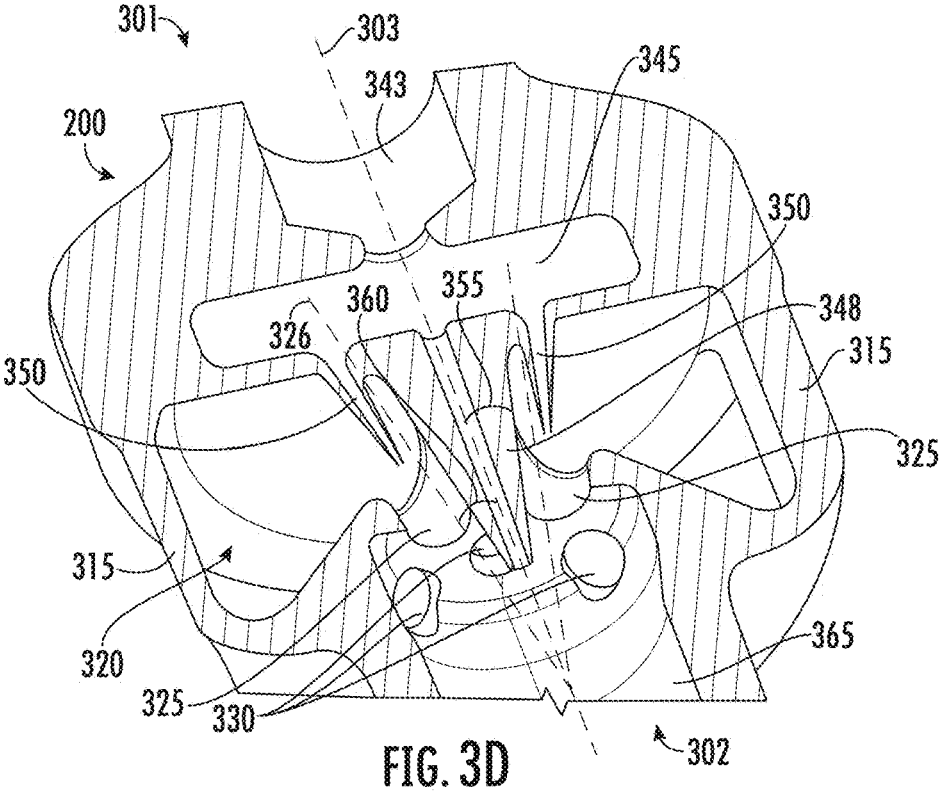
FIG. 3D is a perspective, cross-sectional view of the fuel injector of FIG. 3A, in accordance with embodiments of the present disclosure.
Figure 3E:
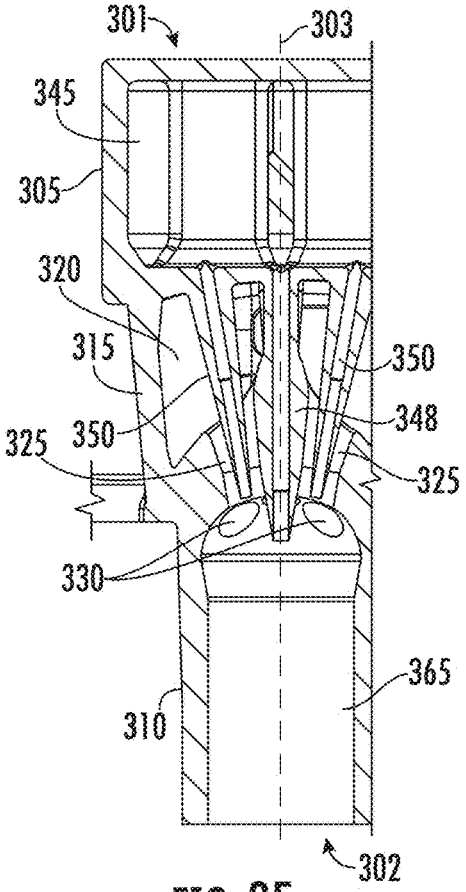
FIG. 3E is a cross-sectional view of the fuel injector of FIG. 3A, in accordance with embodiments of the present disclosure.
Figure 3F:
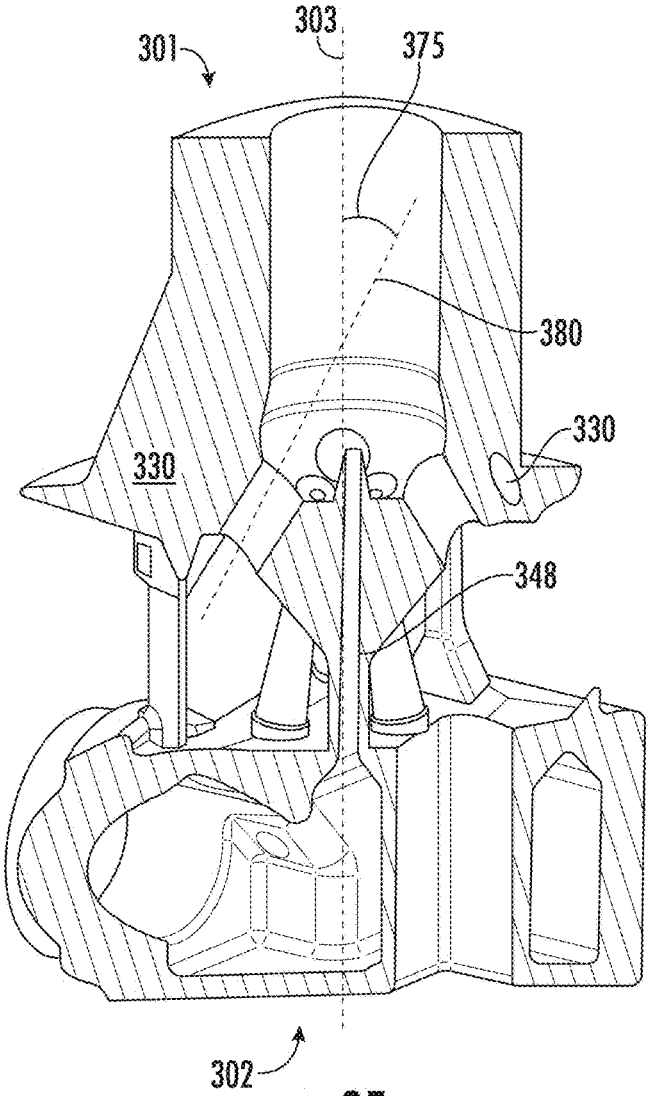
FIG. 3F is a cross-sectional view of the fuel injector of FIG. 3A, taken along line F-F of FIG. 3C, in accordance with embodiments of the present disclosure.

FIG. 3A illustrates a perspective view of the fuel injector 200 as may be employed in the combustor 17 of FIG. 2, in accordance with embodiments of the present disclosure. FIG. 3B illustrates an interior, cross-sectional view of the fuel injector 200 of FIG. 3A, in accordance with embodiments of the present disclosure. FIG. 3C illustrates a bottom view of the fuel injector 200 of FIG. 3A, in accordance with embodiments of the present disclosure. FIG. 3D illustrates a perspective, cross-sectional view of the fuel injector 200 of FIG. 3A, in accordance with embodiments of the present disclosure. FIG. 3E illustrates a cross-sectional view of the fuel injector 200 of FIG. 3A, in accordance with embodiments of the present disclosure. FIG. 3F is a cross-sectional view of the fuel injector of FIG. 3A, taken along line F-F of FIG. 3C, in accordance with embodiments of the present disclosure. As noted above, the fuel injector 200 may be one of a plurality of fuel injectors 200 disposed circumferentially about the combustor 17.

In at least one exemplary embodiment, the fuel injector 200 includes an annular body 300 extending between a first end 301 and a second end 302. The annular body 300 defines a centerline axis 303 extending from the first end 301 to the second end 302. The annular body 300 may include a first end portion 305, a second end portion 310, and a plurality of supports 315 extending between the first end portion 305 and the second end portion 310. For example, the plurality of supports 315 may be coupled between and spaced apart about a perimeter of the first end portion 305 and a perimeter of the second end portion 310. Moreover, the annular body 300 may define a chamber 320 between the first end portion 305, the second end portion 310, and the plurality of supports 315. The chamber 320 may be configured to be in fluid communication with the annulus 47 of the combustor 17 (shown in FIG. 2). Accordingly, the chamber 320 may receive at least a portion of the compressed air 15 from the annulus 47.

As shown in FIGS. 3A-3B, the second end portion 310 includes a base portion 312 adjacent the second end 302 and a top portion 314 extending from the base portion 312 towards the first end 301. For example, the top portion 314 extends into the chamber 320. In at least one exemplary embodiment, as shown, the base portion 312 may include a substantially cylindrical shape (e.g., proximate to the second end 302), and the top portion 314 may have a substantially conical shape.

With reference to FIGS. 3A and 3C, the second end portion 310 of the annular body 300 defines a first plurality of fluid channels 325 disposed radially about the centerline axis 303 and a second plurality of fluid channels 330 disposed radially about the centerline axis 303. For example, the first plurality of fluid channels 325 may be disposed about the centerline axis 303 in a first ring 333, and the second plurality of fluid channels 330 may be disposed about the centerline axis 303 in a second ring 335. The second ring 335 of the second plurality of fluid channels 330 may circumscribe the first ring 333 of the first plurality of fluid channels 325. The first plurality of fluid channels 325 and the second plurality of fluid channels 330 may be equally spaced about the centerline axis 303 (i.e., equally spaced in the circumferential direction). Moreover, the second plurality of fluid channels 330 may be circumferentially offset from the first plurality of fluid channels 325. For example, each of the second plurality of fluid channels 330 may be radially spaced from and positioned circumferentially between adjacent ones of the first plurality of fluid channels 325, as shown in at least FIGS. 3A and 3C.

In at least one exemplary embodiment, each of the first plurality of fluid channels 325 and each of the second plurality of fluid channels 330 have a conical shape. In other example embodiments, each of the first plurality of fluid channels 325 and each of the second plurality of fluid channels 330 have a cylindrical shape.

In at least one example embodiment, a number of the first plurality of fluid channels 325 may be equal to a number of the second plurality of fluid channels 330. For example, there may be four of the first plurality of fluid channels 325 and four of the second plurality of fluid channels 330, as shown in FIGS. 3A-3D. It should be understood, however, that there may be any number of the first plurality of fluid channels 325 and the second plurality of fluid channels 330. For example, there may be two or more of the first plurality of fluid channels 325 and two or more of the second plurality of fluid channels 330. Moreover, the number of the first plurality of fluid channels 325 may be different from the number of the second plurality of fluid channels 330 in other example embodiments.

Now referring to FIG. 3B, at least a portion of a fuel circuit 340 is disposed in the annular body 300 of the fuel injector 200. For example, the first end portion 305 of the annular body 300 may define the fuel circuit 340. The fuel circuit 340 extends along the centerline axis 303 and includes a fuel inlet nozzle 343, a fuel plenum 345 in fluid communication with the fuel inlet nozzle 343, a primary fuel outlet 348 in fluid communication with the fuel plenum 345, and a plurality of secondary fuel outlets 350 in fluid communication with the fuel plenum 345. The fuel inlet nozzle 343 may be configured to receive the second fuel 160 from the second fuel supply 152 via the fuel supply conduit 102, shown in FIG. 2. The fuel plenum 345 may be configured to receive the second fuel 160 from the fuel inlet nozzle 343 and distribute the second fuel 160 to the primary fuel outlet 348 and the plurality of secondary fuel outlets 350. Moreover, the primary fuel outlet 348 may be defined by at least a portion of the first end portion 305 and the second end portion 310 such that the first end portion 305 and the second end portion 310 are fluidly coupled.

As shown in FIG. 3B, the primary fuel outlet 348 extends along the centerline axis 303 from the fuel plenum 345. The plurality of secondary fuel outlets 350 are radially spaced from and disposed about the primary fuel outlet 348. For example, the plurality of secondary fuel outlets 350 may be equally spaced about the centerline axis 303 and the primary fuel outlet 348. In at least one example embodiment, the plurality of secondary fuel outlets 350 are in fluid communication with the first plurality of fluid channels 325. For example, the plurality of secondary fuel outlets 350 may be aligned with and may at least partially extend into the first plurality of fluid channels 325.

Now referring to FIG. 3D, the primary fuel outlet 348 and the plurality of secondary fuel outlets 350 have a substantially conical shape. For example, an exterior surface of the primary fuel outlet 348 and an exterior surface of the plurality of secondary fuel outlets 350 taper from the first end 301 towards the second end 302. The exterior surface of the primary fuel outlet 348 may define a first fuel outlet wall angle 355 relative to the centerline axis 303, as shown in FIG. 3D. Similarly, the centerline 326 of the plurality of secondary fuel outlets 350 may define a second fuel outlet centerline angle 360, also shown in FIG. 3D. In some example embodiments, the first fuel outlet wall angle 355 and the second fuel outlet centerline angle 360 are equal. For example, the first fuel outlet wall angle 355 and the second fuel outlet centerline angle 360 may be about 10°. In other example embodiments, the first fuel outlet wall angle 355 may be greater than or equal to about 5° and less than or equal to about 30°, and the second fuel outlet centerline angle 360 may be greater than or equal to about 5° and less than or equal to about 60°.

With reference to FIG. 3E, an exterior surface of the first plurality of fluid channels 325 defines a first fluid channel angle 370 relative to the centerline axis 303. In at least one example embodiment, the first fluid channel angle 370 is equal to the one or both of the first fuel outlet wall angle 355 and the second fuel outlet centerline angle 360. For example, the first fluid channel angle 370 may be about 10°. In other example embodiments, the first fluid channel angle 370 may be greater than or equal to about 5° and less than or equal to about 30°.

Now referring to FIG. 3F, illustrating a cross-sectional view of the fuel injector of FIG. 3A, taken along line F-F of FIG. 3C, the second plurality of fluid channels 330 defines a second fluid channel angle 375 relative to the centerline axis 303 and a second fluid channel centerline axis 380. In some example embodiments, the second fluid channel angle 375 may be greater than the first fluid channel angle 370. For example, the second fluid channel angle 375 may be about 20°. In other example embodiments, the second fluid channel angle 375 may be greater than or equal to 10° and less than or equal to 60°.

With reference to FIGS. 3B-3E, the fuel injector 200 defines a mixing chamber 365 downstream from the primary fuel outlet 348, the plurality of secondary fuel outlets 350, the first plurality of fluid channels 325, and the second plurality of fluid channels 330. For example, the second end portion 310 of the fuel injector 200 may define at least a portion of the mixing chamber 365.

In operation, the fuel inlet nozzle 343 receives the second fuel 160 from the second fuel supply 152 via the fuel supply conduit 102 (shown in FIG. 2). The second fuel 160 flows from the fuel inlet nozzle 343 to the fuel plenum 345, where the second fuel 160 is distributed to the primary fuel outlet 348 and the plurality of secondary fuel outlets 350. The primary fuel outlet 348 and the plurality of secondary fuel outlets 350 are configured to inject the second fuel 160 into the mixing chamber 365. The plurality of secondary fuel outlets 350 collectively may inject greater than or equal to about 30% and less than or equal to about 70% of the fuel received from the fuel plenum 345 into the mixing chamber 365. For example, the plurality of secondary fuel outlets 350 may inject a greater percentage (greater than 50%) of fuel into the mixing chamber 365 than the primary fuel outlet 348.

As discussed above, the chamber 320 is in fluid communication with the annulus 47 of the combustor 17 (shown in FIG. 2). Accordingly, the chamber 320 is configured to receive at least a portion of the compressed air 15. The first plurality of fluid channels 325 and the second plurality of fluid channels 330 are in fluid communication with the chamber 320 and are configured to direct at least a portion of the compressed air 15 into the mixing chamber 365. The compressed air 15 mixes with the second fuel 160 within the mixing chamber 365 to form a fuel-air mixture.

Moreover, the compressed air 15 is introduced into the mixing chamber 365 from the first plurality of fluid channels 325 at the first fluid channel angle 370 (FIG. 3B) and from the second plurality of fluid channels 330 at the second fluid channel angle 375 (FIG. 3F). The second fuel 160 is introduced into the mixing chamber 365 from the primary fuel outlet 348 along the centerline axis 303 and from the plurality of secondary fuel outlets 350 at the second fuel outlet centerline angle 360 (FIG. 3D). Introducing the compressed air 15 and the second fuel 160 at such angles relative to the centerline axis 303 creates a vortex structure that enhances mixing of the fuel and the air.

For example, a first portion of the compressed air 15 flows through the first plurality of fluid channels 325 at the first fluid channel angle 370 and is discharged into the mixing chamber 365, and a second portion of the compressed air 15 flows through the second plurality of fluid channels 330 at the second fluid channel angle 375 and is also discharged into the mixing chamber 365. Because the second fluid channel angle 375 is greater than the first fluid channel angle 370, the second portion of the compressed air 15 intersects the first portion of the compressed air 15. The second portion of the compressed air 15 also intersects at least a portion of the second fuel 160 entering the mixing chamber 365 from one or both of the primary fuel outlet 348 and the plurality of secondary fuel outlets 350. The second portion of the compressed air 15 moves inward toward the centerline axis 303, and the first portion of the compressed air 15 and at least a portion of the second fuel 160 is pushed outward away from the centerline axis 303. Accordingly, a double vortex is formed within the mixing chamber 365 that promotes mixing of the air and the fuel to form the air-fuel mixture. Moreover, a double vortex may be formed by a pair of one of each of the first plurality of fluid channels 325 and the second plurality of fluid channels 330. For example, in example embodiments where there are four of the first plurality of fluid channels 325 and four of the second plurality of fluid channels 330, four double vortexes may be formed within the mixing chamber 365. From the mixing chamber 365, the fuel-air mixture may be injected into the secondary combustion zone 74 of the combustor 17 (FIG. 2).

Figure 4A:
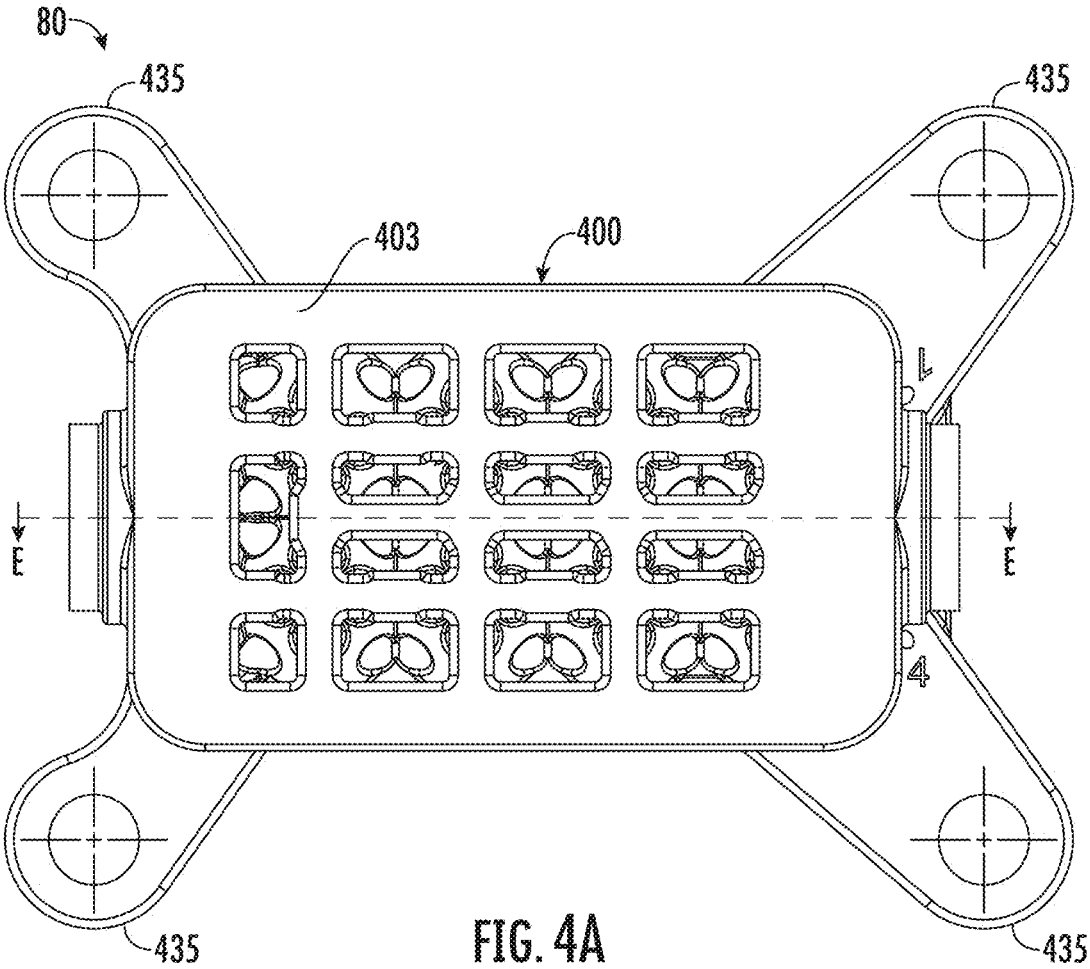
FIG. 4A is a top view of a fuel injection assembly as may be employed in the combustor of FIG. 2, in accordance with embodiments of the present disclosure.
Figure 4B:
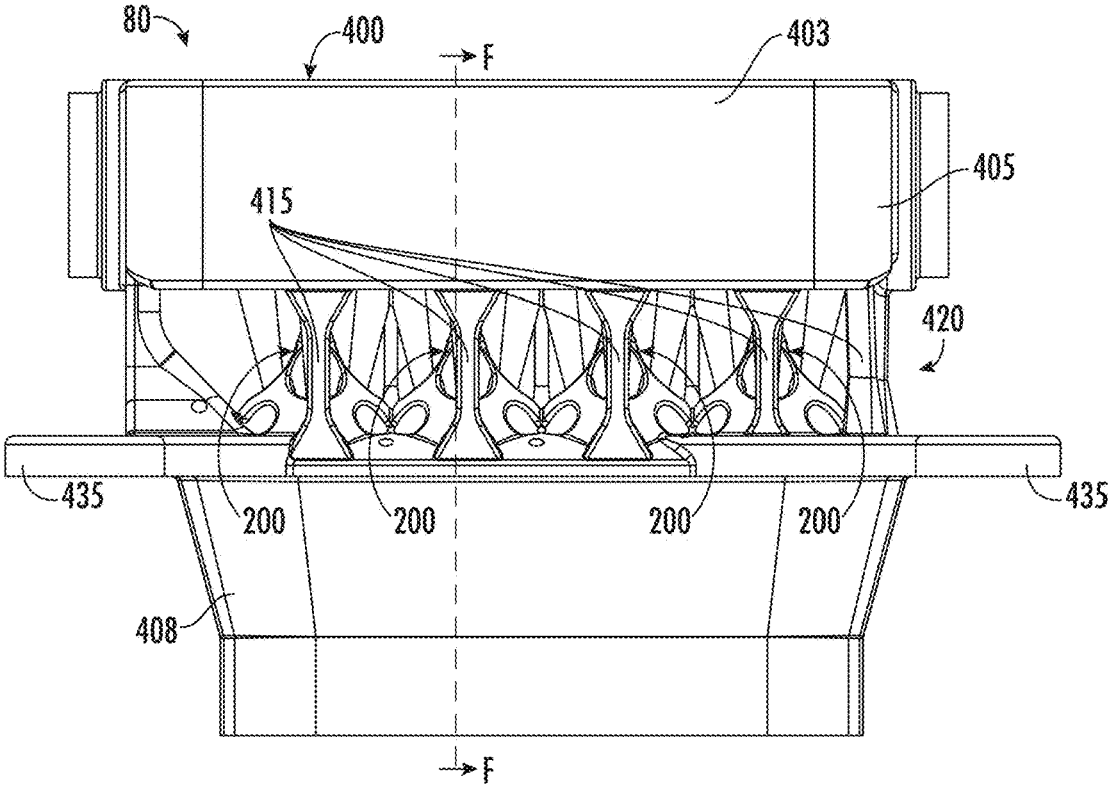
FIG. 4B is a side view of the fuel injection assembly of FIG. 4A, in accordance with embodiments of the present disclosure.
Figure 4C:
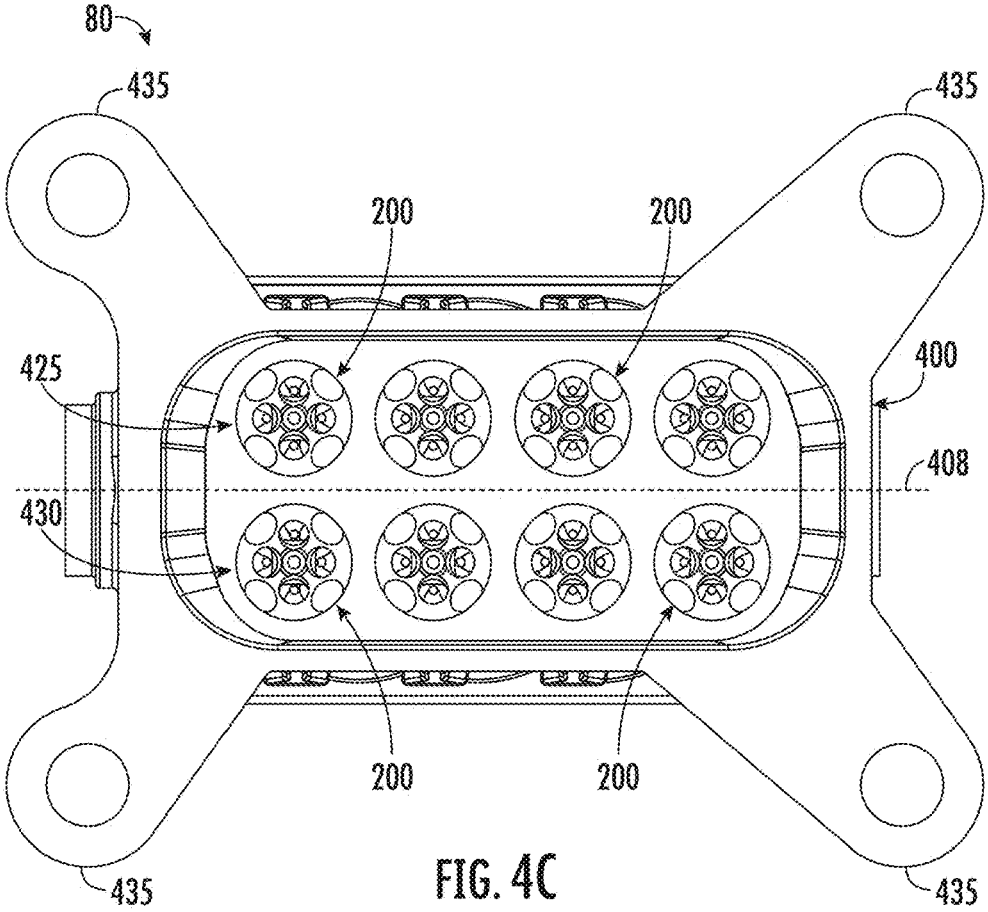
FIG. 4C is a bottom view of the fuel injection assembly of FIG. 4A, in accordance with embodiments of the present disclosure.
Figure 4D:
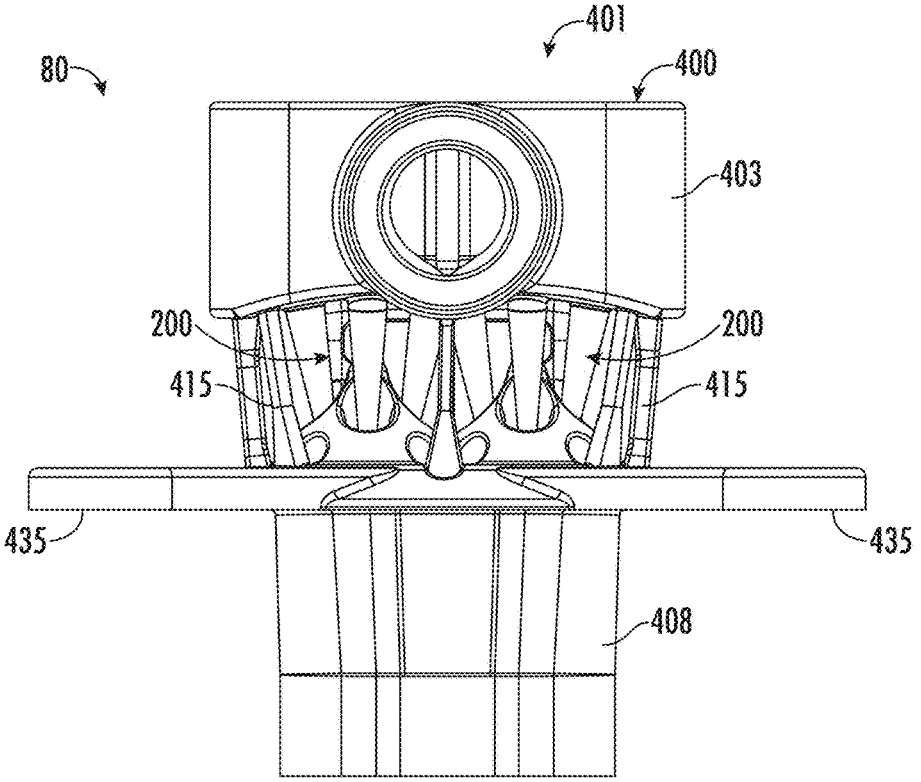
FIG. 4D is an end view of the fuel injection assembly of FIG. 4A, in accordance with embodiments of the present disclosure.
Figure 4E:
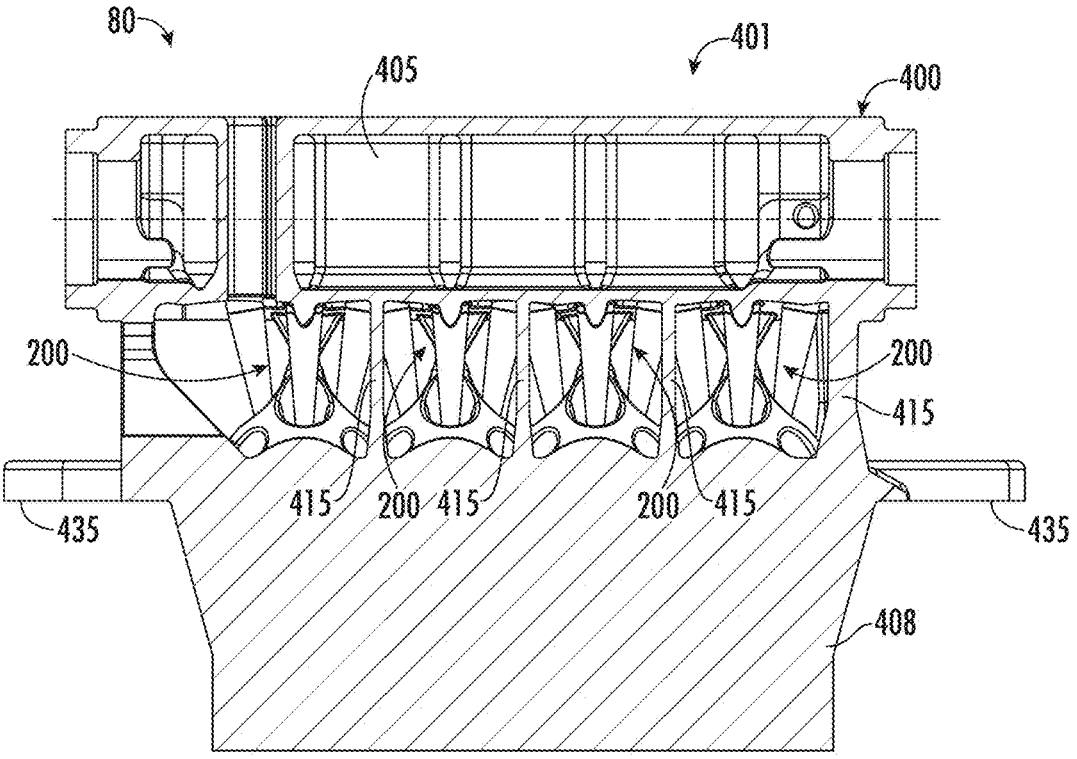
FIG. 4E is a cross-sectional side view of the fuel injection assembly of FIG. 4A along line E-E, in accordance with embodiments of the present disclosure.
Figure 4F:
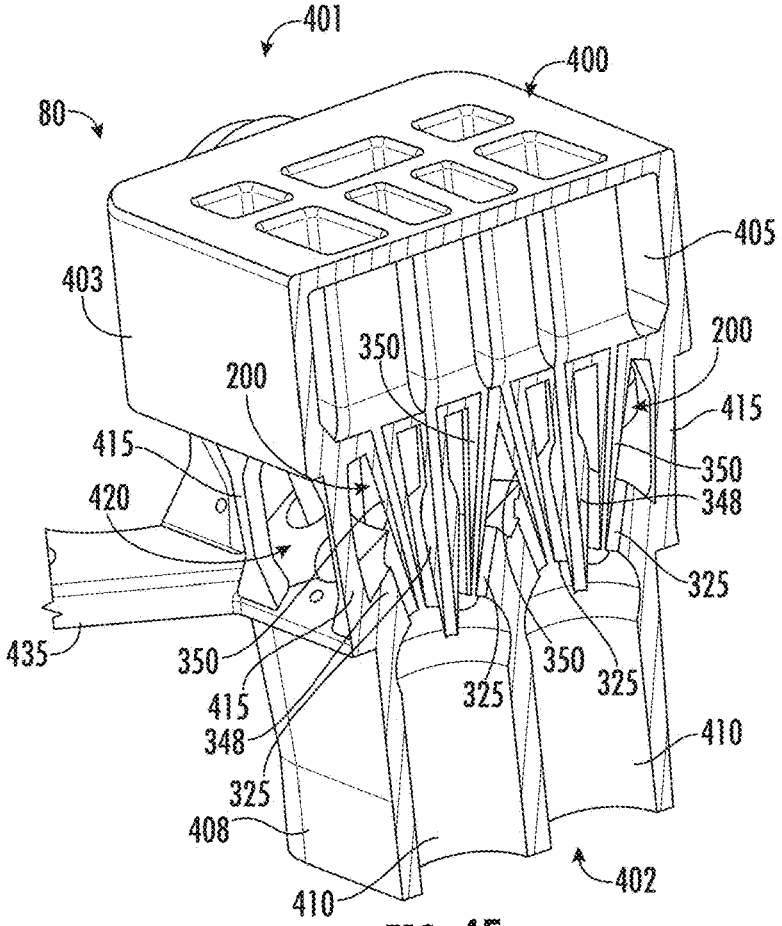
FIG. 4F is a cross-sectional view of the fuel injection assembly of FIG. 4A, taken along line F-F of FIG. 4B, in accordance with embodiments of the present disclosure.
Figure 4G:
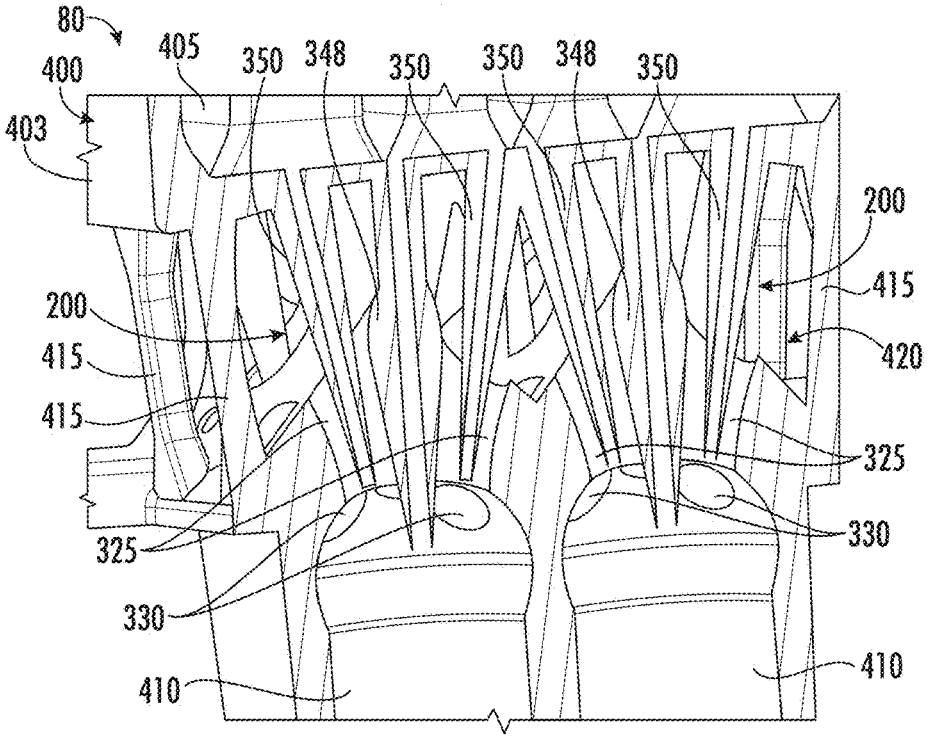
FIG. 4G is a detailed view of the cross-section of the fuel injection assembly of FIG. 4F, in accordance with embodiments of the present disclosure.

FIG. 4A illustrates a top view of the fuel injection assembly 80 as may be employed in the combustor 17 of FIG. 2, in accordance with embodiments of the present disclosure. FIG. 4B illustrates a side view of the fuel injection assembly 80 of FIG. 4A, in accordance with embodiments of the present disclosure. FIG. 4C illustrates a bottom view of the fuel injection assembly 80 of FIG. 4A, in accordance with embodiments of the present disclosure. FIG. 4D illustrates an end view of the fuel injection assembly 80 assembly of FIG. 4A, in accordance with embodiments of the present disclosure. FIG. 4E illustrates a cross-sectional view of the fuel injection assembly 80 of FIG. 4A, taken along line E-E of FIG. 4A, in accordance with embodiments of the present disclosure. FIG. 4F illustrates a cross-sectional view of the fuel injection assembly 80 of FIG. 4A, taken along line F-F of FIG. 4B, in accordance with embodiments of the present disclosure. FIG. 4G illustrates a detailed view of the cross-section of the fuel injection assembly 80 of FIG. 4F, in accordance with embodiments of the present disclosure.

The fuel injection assembly 80 includes a housing 400 extending between a first end 401 and a second end 402, as shown in FIG. 4D. The housing 400 includes a first portion 403 adjacent the first end 401 and a second portion 408 adjacent the second end 402. Additionally, a plurality of support structures 415 is coupled between the first portion 403 and the second portion 408. The housing 400 defines an air plenum 420 (FIGS. 4F-4G) between the first portion 403, the second portion 408, and the plurality of support structures 415.

The housing 400 may include one or more mounting structures 435 configured to mount the housing 400 to the combustor 17. For example, the one or more mounting structures 435 may be configured to secure the housing 400 to the outer sleeve 48 of the combustor (shown in FIG. 2). The one or more mounting structures 435 may define at least one opening for receiving at least one fastener, such as a bolt, pin, or screw, for securing the housing 400 to the combustor 17. Additionally, the one or more mounting structures 435 may at least partially extend from a periphery of the second portion 408 of the housing 400. In other example embodiments, the one or more mounting structures 435 may extend at least partially from a periphery of the first portion 403 of the housing 400.

In at least one exemplary embodiment, the first portion 403 of the housing 400 defines a fuel chamber 405 (shown in FIGS. 4E-4F), and the second portion 408 of the housing 400 defines at least one mixing chamber 410 (shown in FIGS. 4F-4G). The fuel chamber 405 is configured to be in fluid communication with a fuel source, such as the second fuel supply 152. For example, the fuel chamber 405 may be in fluid communication with the second fuel supply 152 via the fuel supply conduit 102, shown in FIG. 2.

In at least one exemplary embodiment, a plurality of fuel injectors 200 is disposed in the housing 400. For example, a plurality of the fuel injectors 200 may be disposed at least partially within the air plenum 420 of the housing 400. The plurality of the fuel injectors 200 may be in fluid communication with and downstream of the fuel chamber 405 and in fluid communication with and upstream of the at least one mixing chamber 410. In such an arrangement, the fuel chamber 405 is common to the plurality of fuel injectors 200.

With reference to FIG. 4C, the plurality of the fuel injectors 200 may be disposed in the housing 400 in at least one row. For example, the housing 400 may include a first row 425 and a second row 430 of the plurality of the fuel injectors 200. The first row 425 and the second row 430 may include the same number of the plurality of the fuel injectors 200. For example, the first row 425 and the second row 430 each include four of the plurality of the fuel injectors 200, which are axially aligned with one another. In other example embodiments, the first row 425 and the second row 430 may include two or more of the plurality of the fuel injectors 200. In still other example embodiments, the housing 400 may include greater than two rows of the plurality of the fuel injectors 200. In still other exemplary embodiments, the first row 425 of fuel injectors 200 may be axially offset from the second row 430 of fuel injectors 200.

Each fuel injector 200 of the plurality of the fuel injectors 200 is similar or analogous to the fuel injector 200 discussed above with respect to FIGS. 3A-3F. For example, with reference to FIGS. 4F-4G, the fuel circuit 340 is in fluid communication with the fuel chamber 405 and the plurality of fuel injectors 200. More specifically, the fuel circuit 340 includes the primary fuel outlet 348 and the plurality of secondary fuel outlets 350 of each respective fuel injector 200. The primary fuel outlet 348 and the plurality of secondary fuel outlets 350 may extend from the first portion 403 of the housing 400 towards the second portion 408. Moreover, the primary fuel outlet 348 and the plurality of secondary fuel outlets 350 may at least partially extend into the second portion 408 of the housing 400. Additionally, the primary fuel outlet 348 and the plurality of secondary fuel outlets 350 may be in direct fluid communication with the fuel chamber 405, as shown in FIGS. 4F-4G. In other example embodiments, the primary fuel outlet 348 and the plurality of secondary fuel outlets 350 may be in fluid communication with the fuel chamber 405 via one or both of the fuel inlet nozzle 343 and the fuel plenum 345, as shown in FIGS. 3B and 3D.

The plurality of the fuel injectors 200 also include the first plurality of fluid channels 325 and the second plurality of fluid channels 330. For example, the second portion 408 of the housing 400 may define the first plurality of fluid channels 325 and the second plurality of fluid channels 330. As shown in FIGS. 4F-4G, the first plurality of fluid channels 325 and the second plurality of fluid channels 330 are in fluid communication with the air plenum 420 and the at least one mixing chamber 410. Moreover, the plurality of secondary fuel outlets 350 extend at least partially into the first plurality of fluid channels 325. Additionally, the primary fuel outlet 348 may extend at least partially into the at least one mixing chamber 410. Each of the mixing chambers 410 may be similar or analogous to the mixing chamber 365 discussed above with respect to FIGS. 3A-3F.

In at least one exemplary embodiment, the at least one mixing chamber 410 is in fluid communication with the combustor 17 (FIG. 2). For example, the plurality of the fuel injectors 200 are configured to receive the second fuel 160 via the fuel chamber 405 and deliver the second fuel 160 to the at least one mixing chamber 410 via the primary fuel outlet 348 and the plurality of secondary fuel outlets 350 of each respective fuel injector 200. Additionally, each of the plurality of the fuel injectors 200 receives at least a portion of the compressed air 15 via the air plenum 420 and delivers the compressed air 15 to the at least one mixing chamber 410 via the first plurality of fluid channels 325 and the second plurality of fluid channels 330. Accordingly, the compressed air 15 mixes with the second fuel 160 within the at least one mixing chamber 410 to form a fuel-air mixture.

As discussed above with respect to FIGS. 3A-3F, mixing of the second fuel 160 and the compressed air 15 within the at least one mixing chamber 410 is enhanced based on the compressed air 15 entering the at least one mixing chamber at the first fluid channel angle 370 (FIG. 3B) from the first plurality of fluid channels 325 and at the second fluid channel angle 375 (FIG. 3F) from the second plurality of fluid channels 330 and based on the second fuel 160 entering the at least one mixing chamber 410 along the centerline axis 303 from the primary fuel outlet 348 and at the second fuel outlet centerline angle 360 from the plurality of secondary fuel outlets 350 (shown in FIG. 3D). Delivery of the compressed air 15 and the second fuel 160 to the at least one mixing chamber 410 at such angles creates a double vortex structure within the at least one mixing chamber 410 that enhances mixing of the compressed air 15 and the second fuel 160, while reducing the likelihood of flashback and/or flame holding within the mixing chamber 410. The at least one mixing chamber 410 of the housing 400 is in fluid communication with the combustor 17. Accordingly, from the at least one mixing chamber 410, the fuel-air mixture is injected into the secondary combustion zone 74 of the combustor 17 (shown in FIG. 2).

Figure 5A:
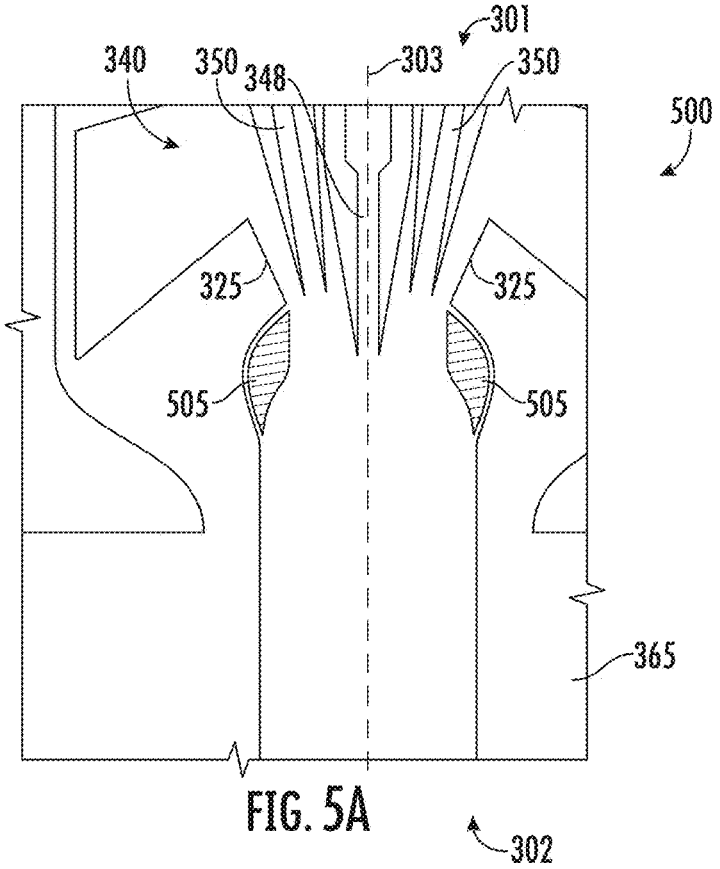
FIG. 5A is a cross-sectional view of a fuel injector, in accordance with embodiments of the present disclosure.
Figure 5B:
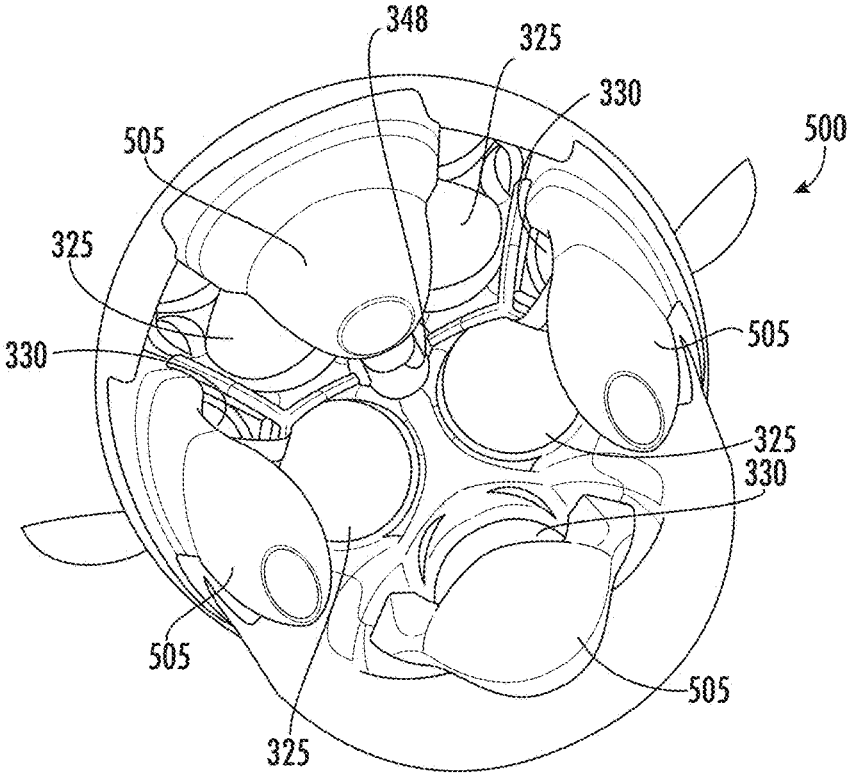
FIG. 5B is a bottom perspective view of the fuel injector of FIG. 5A, in accordance with embodiments of the present disclosure.

FIG. 5A illustrates a cross-sectional view of a fuel injector 500, in accordance with embodiments of the present disclosure. FIG. 5B illustrates a bottom perspective view of the fuel injector 500 of FIG. 5A, in accordance with embodiments of the present disclosure. The fuel injector 500 may be incorporated into the fuel injection assembly 80 in place of the fuel injector 200 discussed above with respect to FIGS.

3A-4G. Additionally, the fuel injector 500 may be similar or analogous to the fuel injector 200 discussed above with respect to FIGS. 3A-3F.

For example, the fuel injector 500 includes the fuel circuit 340. The fuel circuit 340 includes the primary fuel outlet 348 and the plurality of secondary fuel outlets 350. Although not shown in FIGS. 5A-5B, the fuel circuit 340 may also include one or both of the fuel inlet nozzle 343 and the fuel plenum 345. The fuel injector 500 also includes the first plurality of fluid channels 325 and the second plurality of fluid channels 330.

In at least one example embodiment, the fuel injector 500 defines a plurality of wall extension 505. The plurality of wall extensions 505 extend from an interior surface of the mixing chamber 365 adjacent the second plurality of fluid channels 330. The plurality of wall extensions 505 may be evenly spaced radially about the centerline axis 303. More specifically, the plurality of wall extensions 505 may be positioned between the second plurality of fluid channels 330 in some example embodiments. Moreover, the plurality of wall extensions 505 may be integral with the fuel injector 200, such as integral with the mixing chamber 365. For example, the plurality of wall extensions 505 include an iso-surface or three-dimensional surface extending from an interior surface of the mixing chamber 365.

In at least one exemplary embodiment, the plurality of wall extensions 505 are disposed in low velocity regions of the mixing chamber 365. For example, without the plurality of wall extensions 505, the velocity of the second fuel 160 and the compressed air 15 entering the mixing chamber 365 may be lower in such low velocity regions than in surrounding areas. Accordingly, the plurality of wall extensions 505 may be configured to fill such low velocity regions to prevent fuel from entering the low velocity regions and, thereby, prevent flame holding in such low velocity regions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are summarized by the subject matter of the following clauses:

A fuel injector for a combustor of a gas turbine, comprising: an annular body extending from a first end to a second end, the annular body defining a centerline axis extending from the first end to the second end; a fuel circuit at least partially disposed in the annular body, the fuel circuit comprising a fuel plenum, a primary fuel outlet in fluid communication with the fuel plenum and extending along the centerline axis, and a plurality of secondary fuel outlets in fluid communication with the fuel plenum and disposed radially about the primary fuel outlet; a first plurality of fluid channels radially disposed about the centerline axis, the first plurality of fluid channels in fluid communication with the plurality of secondary fuel outlets; and a second plurality of fluid channels radially disposed about the first plurality of fluid channels.

The fuel injector of one or more of these clauses, wherein: the primary fuel outlet and each secondary fuel outlet of the plurality of secondary fuel outlets comprise a conical shape; the primary fuel outlet forms a first fuel outlet wall angle relative to the centerline axis; and each secondary fuel outlet of the plurality of secondary fuel outlets forms a second fuel outlet centerline angle relative to the centerline axis.

The fuel injector of one or more of these clauses, wherein: the first fuel outlet wall angle is about 10°; and the second fuel outlet centerline angle is about 10°.

The fuel injector of one or more of these clauses, wherein: the plurality of secondary fuel outlets is equally spaced about the centerline axis; the first plurality of fluid channels is equally spaced about the centerline axis; and the second plurality of fluid channels is equally spaced about the centerline axis.

The fuel injector of one or more of these clauses, wherein: the plurality of secondary fuel outlets is aligned circumferentially with the first plurality of fluid channels; and the second plurality of fluid channels is offset circumferentially from the first plurality of fluid channels.

The fuel injector of one or more of these clauses, wherein: each fluid channel of the second plurality of fluid channels forms a second fluid channel angle relative to the centerline axis; and the second fluid channel angle is about 20°.

The fuel injector of one or more of these clauses, wherein: the plurality of secondary fuel outlets comprises four secondary fuel outlets; the first plurality of fluid channels comprises four fluid channels; and the second plurality of fluid channels comprises four fluid channels.

The fuel injector of one or more of these clauses, further comprising a mixing chamber downstream of and in fluid communication with the primary fuel outlet, the plurality of secondary fuel outlets, the first plurality of fluid channels, and the second plurality of fluid channels.

The fuel injector of one or more of these clauses, wherein each fluid channel of the first plurality of fluid channels and each fluid channel of the second plurality of fluid channels comprise a conical shape.

The fuel injector of one or more of these clauses, wherein: the annular body defines a plurality of wall extensions extending from an interior surface of the annular body, the plurality of wall extensions spaced about the centerline axis; and each wall extension of the plurality of wall extensions is disposed between circumferentially adjacent fluid channels of the second plurality of fluid channels.

A combustor comprising: a combustion liner extending in a downstream direction and defining a combustion chamber; an outer sleeve spaced apart from and surrounding the combustion liner such that an annulus is defined therebetween; and a fuel injection assembly coupled to the outer sleeve and in fluid communication with a fuel source, the fuel injection assembly comprising: a housing extending between a first housing end and a second housing end, the first housing end defining a fuel chamber configured to receive fuel from the fuel source, the second housing end defining at least one mixing chamber, and at least one fuel injector disposed in the housing and in fluid communication with the fuel chamber and the at least one mixing chamber; wherein the at least one fuel injector comprises: an annular body extending from a first end to a second end, the annular body defining a centerline axis extending from the first end to the second end, a fuel circuit at least partially disposed in the annular body, the fuel circuit comprising a fuel plenum in fluid communication with the fuel chamber; a primary fuel outlet in fluid communication with the fuel plenum and extending along the centerline axis; and a plurality of secondary fuel outlets in fluid communication with the fuel plenum and disposed radially about the primary fuel outlet; a first plurality of fluid channels radially disposed about the centerline axis, the first plurality of fluid channels in fluid communication with the plurality of secondary fuel outlets; and a second plurality of fluid channels radially disposed about the first plurality of fluid channels.

The combustor of one or more of these clauses, wherein the at least one fuel injector comprises: a first plurality of fuel injectors arranged in a first row; and a second plurality of fuel injectors arranged in a second row adjacent the first row.

The combustor of one or more of these clauses, wherein the first plurality of fluid channels and the second plurality of fluid channels are in fluid communication with the annulus between the combustion liner and the outer sleeve.

The combustor of one or more of these clauses, wherein: the primary fuel outlet and each secondary fuel outlet of the plurality of secondary fuel outlets comprise a conical shape; the primary fuel outlet forms a first fuel outlet wall angle relative to the centerline axis; and each secondary fuel outlet of the plurality of secondary fuel outlets forms a second fuel outlet centerline angle relative to the centerline axis.

The combustor of one or more of these clauses, wherein: the first fuel outlet wall angle is about 10°; and the second fuel outlet centerline angle is about 10°.

The combustor of one or more of these clauses, wherein: the plurality of secondary fuel outlets is equally spaced about the centerline axis; the first plurality of fluid channels is equally spaced about the centerline axis; and the second plurality of fluid channels is equally spaced about the centerline axis.

The combustor of one or more of these clauses, wherein: the plurality of secondary fuel outlets is aligned circumferentially with the first plurality of fluid channels; and the second plurality of fluid channels is circumferentially offset from the first plurality of fluid channels.

The combustor of one or more of these clauses, wherein: each fluid channel of the second plurality of fluid channels forms a second fluid channel angle relative to the centerline axis; and the second fluid channel angle is about 20°.

The combustor of one or more of these clauses, wherein: the annular body defines a plurality of wall extensions extending from an interior surface of the annular body, the plurality of wall extensions spaced about the centerline axis; and each wall extension of the plurality of wall extensions is disposed between circumferentially adjacent fluid channels of the second plurality of fluid channels.

The combustor of one or more of these clauses, further comprising a fuel supply conduit coupled to the fuel source, the fuel source supplying a fuel containing pure hydrogen or a fuel mixture of hydrogen and natural gas, where hydrogen is a majority component of the fuel mixture.

What is claimed is:

1. A fuel injector for a combustor of a gas turbine, comprising:

an annular body extending from a first end to a second end, the annular body defining a centerline axis extending from the first end to the second end, wherein the annular body defines a plurality of wall extensions extending from an interior surface of the annular body, the plurality of wall extensions spaced about the centerline axis;

a fuel circuit at least partially disposed in the annular body, the fuel circuit comprising a fuel plenum, a primary fuel outlet in fluid communication with the fuel plenum and extending along the centerline axis, and a plurality of secondary fuel outlets in fluid communication with the fuel plenum and disposed radially about the primary fuel outlet;

a first plurality of fluid channels radially disposed about the centerline axis, the first plurality of fluid channels in fluid communication with the plurality of secondary fuel outlets, wherein the plurality of secondary fuel outlets extend at least partially into the first plurality of fluid channels; and a second plurality of fluid channels radially disposed about the first plurality of fluid channels;

wherein each wall extension of the plurality of wall extensions is between circumferentially adjacent fluid channels of the second plurality of fluid channels.

2. The fuel injector of claim 1, wherein:

the primary fuel outlet and each secondary fuel outlet of the plurality of secondary fuel outlets comprise a conical shape;

the primary fuel outlet forms a first fuel outlet wall angle relative to the centerline axis; and each secondary fuel outlet of the plurality of secondary fuel outlets forms a second fuel outlet centerline angle relative to the centerline axis.

3. The fuel injector of claim 2, wherein:

the first fuel outlet wall angle is about 10°; and the second fuel outlet centerline angle is about 10°.

4. The fuel injector of claim 1, wherein:

the plurality of secondary fuel outlets are equally spaced about the centerline axis;

the first plurality of fluid channels are equally spaced about the centerline axis; and the second plurality of fluid channels are equally spaced about the centerline axis.

5. The fuel injector of claim 4, wherein:

the plurality of secondary fuel outlets are aligned circumferentially with the first plurality of fluid channels; and the second plurality of fluid channels are offset circumferentially from the first plurality of fluid channels.

6. The fuel injector of claim 1, wherein:

each fluid channel of the second plurality of fluid channels forms a second fluid channel angle relative to the centerline axis; and the second fluid channel angle is about 20°.

7. The fuel injector of claim 1, wherein:

the plurality of secondary fuel outlets comprises four secondary fuel outlets;

the first plurality of fluid channels comprises four fluid channels; and the second plurality of fluid channels comprises four fluid channels.

8. The fuel injector of claim 1, further comprising a mixing chamber downstream of and in fluid communication with the primary fuel outlet, the plurality of secondary fuel outlets, the first plurality of fluid channels, and the second plurality of fluid channels.

9. The fuel injector of claim 1, wherein the first plurality of fluid channels and the second plurality of fluid channels comprise a conical shape.

10. A combustor comprising:

a combustion liner extending in a downstream direction and defining a combustion chamber;

an outer sleeve spaced apart from and surrounding the combustion liner such that an annulus is defined therebetween; and a fuel injection assembly coupled to the outer sleeve and in fluid communication with a fuel source, the fuel injection assembly comprising:

a housing extending between a first housing end and a second housing end, the first housing end defining a fuel chamber configured to receive a fuel from the fuel source, the second housing end defining at least one mixing chamber; and at least one fuel injector disposed in the housing and in fluid communication with the fuel chamber and the at least one mixing chamber;

wherein the at least one fuel injector comprises:

an annular body extending from a first end to a second end, the annular body defining a centerline axis extending from the first end to the second end, wherein the annular body defines a plurality of wall extensions extending from an interior surface of the annular body, the plurality of wall extensions spaced about the centerline axis, a fuel circuit at least partially disposed in the annular body, the fuel circuit comprising a fuel plenum in fluid communication with the fuel chamber, a primary fuel outlet in fluid communication with the fuel plenum and extending along the centerline axis, and a plurality of secondary fuel outlets in fluid communication with the fuel plenum and disposed radially about the primary fuel outlet, a first plurality of fluid channels radially disposed about the centerline axis, the first plurality of fluid channels in fluid communication with the plurality of secondary fuel outlets, wherein the plurality of secondary fuel outlets extend at least partially into the first plurality of fluid channels, and a second plurality of fluid channels radially disposed about the first plurality of fluid channels, wherein each wall extension of the plurality of wall extensions is between circumferentially adjacent fluid channels of the second plurality of fluid channels.

11. The combustor of claim 10, wherein the at least one fuel injector comprises:

a first plurality of fuel injectors arranged in a first row; and a second plurality of fuel injectors arranged in a second row adjacent the first row.

12. The combustor of claim 10, wherein the first plurality of fluid channels and the second plurality of fluid channels are in fluid communication with the annulus between the combustion liner and the outer sleeve.

13. The combustor of claim 10, wherein:

the primary fuel outlet and each secondary fuel outlet of the plurality of secondary fuel outlets comprise a conical shape;

the primary fuel outlet forms a first fuel outlet wall angle relative to the centerline axis; and each secondary fuel outlet of the plurality of secondary fuel outlets forms a second fuel outlet centerline angle relative to the centerline axis.

14. The combustor of claim 13, wherein:

the first fuel outlet wall angle is about 10°; and the second fuel outlet centerline angle is about 10°.

15. The combustor of claim 10, wherein:

the plurality of secondary fuel outlets are equally spaced about the centerline axis;

the first plurality of fluid channels are equally spaced about the centerline axis; and the second plurality of fluid channels are equally spaced about the centerline axis.

16. The combustor of claim 10, wherein:

the plurality of secondary fuel outlets are aligned circumferentially with the first plurality of fluid channels; and the second plurality of fluid channels are offset circumferentially from the first plurality of fluid channels.

17. The combustor of claim 10, wherein:

each fluid channel of the second plurality of fluid channels forms a second fluid channel angle relative to the centerline axis; and the second fluid channel angle is about 20°.

18. The combustor of claim 10, further comprising a fuel supply conduit coupled to the fuel source, the fuel source supplying a fuel containing pure hydrogen or a fuel mixture of hydrogen and natural gas, where hydrogen is a majority component of the fuel mixture.

* * * * *